US006632105B2

(12) United States Patent
Zhang et al.

(10) Patent No.: US 6,632,105 B2
(45) Date of Patent: Oct. 14, 2003

(54) INPUT/OUTPUT CONNECTOR HAVING FIRMLY ASSEMBLED INSULATIVE HOUSING AND SHELL

(75) Inventors: JianQiang Zhang, Kunsan (CN); LiQi Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/101,294

(22) Filed: Mar. 18, 2002

(65) Prior Publication Data

US 2003/0036309 A1 Feb. 20, 2003

(30) Foreign Application Priority Data

Aug. 17, 2001 (TW) ..... 90214111 U

(51) Int. Cl.[7] ..... H01R 13/648; H01R 13/40; H01R 13/627

(52) U.S. Cl. ..... 439/607; 439/594; 439/352

(58) Field of Search ..... 439/607, 892, 439/594, 597, 601, 352

(56) References Cited

U.S. PATENT DOCUMENTS

| | | | | |
|---|---|---|---|---|
| 5,407,366 A | * | 4/1995 | Briones et al. | 439/639 |
| 6,093,057 A | * | 7/2000 | Lok | 439/607 |
| 6,241,556 B1 | * | 6/2001 | Chih | 439/607 |
| 6,375,498 B1 | * | 4/2002 | Yu et al. | 439/567 |

* cited by examiner

*Primary Examiner*—Chandrika Prasad
(74) *Attorney, Agent, or Firm*—Wei Te Chung

(57) ABSTRACT

An input/output connector (1) has an insulative housing (10), a plurality of conductive contacts (20) retained in the insulative housing for surface mounting to a printed circuit board and a shell (30). The insulative housing has a hole (130) extending in a front-to-back direction and a recess (131) communicating with the hole. The shell includes a top plate (31), a bottom plate (32) and a pair of side plates (33) connecting the bottom plate and the top plate. The bottom plate has a pair of cantilevers (320) extending perpendicularly and rearwardly to be inserted into the hole of the insulative housing and then be bent to be received in the recess of the insulative housing for preventing the shell from bulging downwardly.

13 Claims, 5 Drawing Sheets

INPUT/OUTPUT CONNECTOR HAVING FIRMLY ASSEMBLED INSULATIVE HOUSING AND SHELL

FIELD OF THE INVENTION

The present invention relates to an electrical connector, and particularly to an input/output (I/O) connector for an electrical device.

BACKGROUND OF THE INVENTION

An input/output (I/O) connector is commonly used in an electrical device for transferring signals. A conventional I/O connector as disclosed in FIGS. 1 and 2 includes an insulative housing receiving a plurality of conductive contacts therein and a shell. The shell, before completely assembled to the housing, has a bottom plate and a pair of horizontally and rearwardly extending cantilevers 320' connect with the bottom plate. The insulative housing has a hole extending in a front-to-back direction. A recess 131' communicating with the hole is defined in a rear surface of the insulative housing and is divided into an upper portion and a lower portion by the hole. The pair of cantilevers 320' extend through the hole and are bent upwardly to be held in the recess 131', therefore the insulative housing is assembled with the shell. However, the cantilevers 320' only press on the upper portion of the recess and do not press on the lower portion of the recess, so during soldering the I/O connector to a print circuit board (PCB), the bottom plate of the shell will bulge downwardly due to differences in thermal expansion coefficients, heat conductivity and stress between the insulative housing and the shell, which will destroy the electrical connection between the conductive contacts and the PCB.

Hence, an improved I/O connector is needed to overcome the above-mentioned deficiencies of current I/O connectors.

SUMMARY OF THE INVENTION

Accordingly, a primary object of the present invention is to provide an Input/Output (I/O) connector for firmly assembling an insulative housing with a shell.

To achieve the above object, an I/O connector in accordance with the present invention comprises an insulative housing, a plurality of conductive contacts retained in the insulative housing for surface mounting to a printed circuit board and a shell. The insulative housing includes a first housing portion, a second housing portion and a connecting portion connecting the first housing portion and the second housing portion. The connecting portion has a hole extending in a front-to-back direction and a recess communicating with the hole. The recess has an upper wall surface and a lower wall surface. The shell is made of a one-piece metal sheet and includes a top plate, a bottom plate and a pair of side plates connecting the bottom plate and the top plate. The bottom plate has a pair of cantilevers extending perpendicularly and rearwardly to insert into the hole of the insulative housing and then be bent to be received in the recess of the insulative housing, thereby confines the pair of cantilevers between the upper and the lower wall surfaces for preventing the shell from bulging downwardly.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
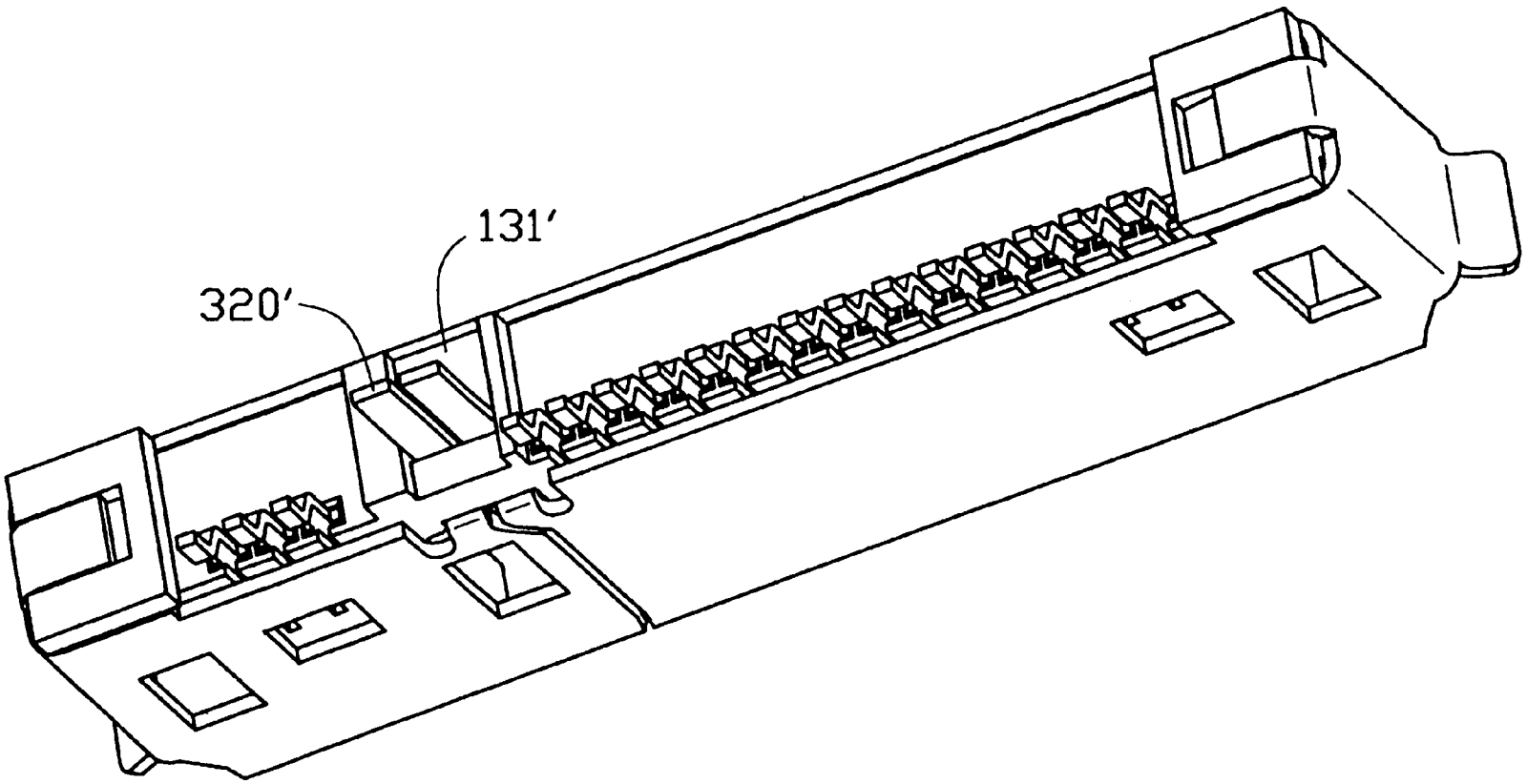
FIG. 1 (PRIOR ART)
FIG. 1 is an assembled view of a conventional input/output (I/O) connector, wherein a pair of cantilevers of the I/O connector are not bent.
Figure 2:
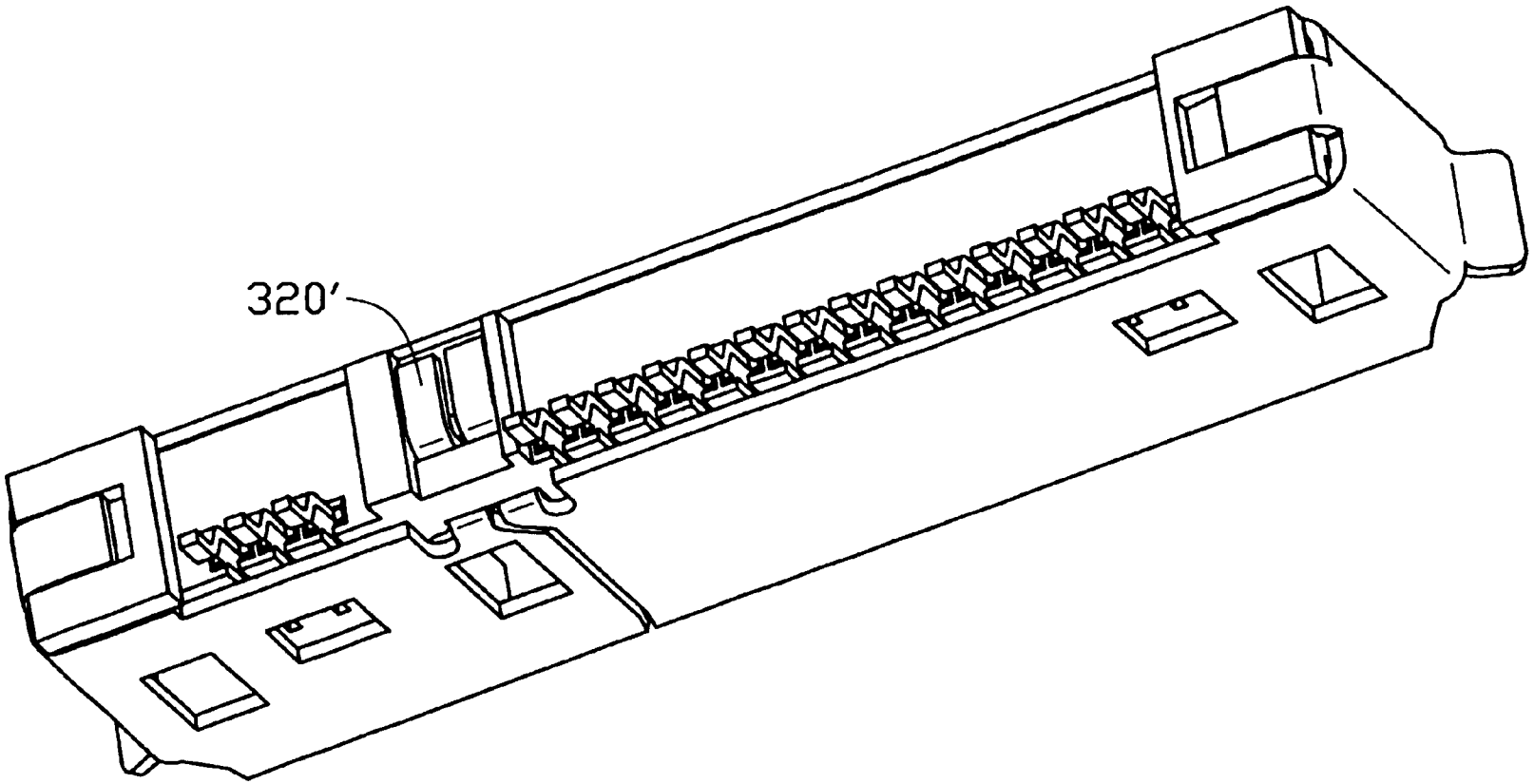
FIG. 2 (PRIOR ART)
FIG. 2 is an assembled view of the I/O connector of FIG. 1, wherein the pair of cantilevers of the I/O connector are bent.
Figure 3:
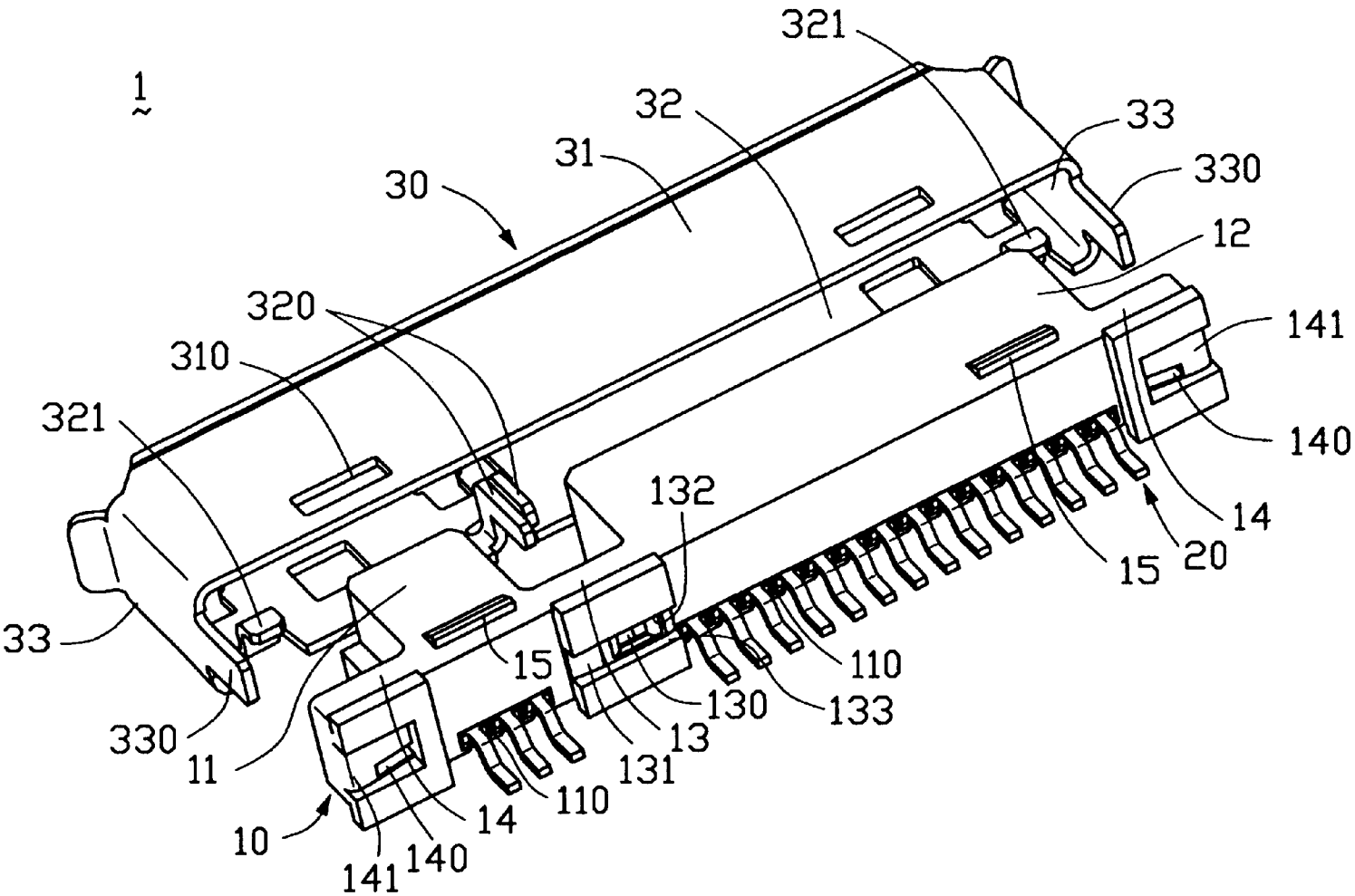
FIG. 3 is an exploded view of an I/O connector in accordance with the present invention.

Referring to FIG. 3, an I/O connector 1 in accordance with the present invention comprises an insulative housing 10, a plurality of conductive contacts 20 retained in the insulative housing 10 for surface mounting to a printed circuit board (PCB) (not shown) and a shell 30.

The insulative housing 10 includes a first housing portion 11 defining a long port (not labeled), a second housing portion 12 defining a short port (not labeled), and a connecting portion 13 connecting the first housing portion 11 and the second housing portion 12.

The shell 30 is made of a one-piece metal sheet and includes a top plate 31, a bottom plate 32, a pair of side plates 33 connecting the top plate 31 and the bottom plate 32. A pair of cantilevers 320 corresponding to the hole 130 extends perpendicularly and rearwardly from a respective free end of the bottom plate 32, and the cantilevers 320 are face-to-face confronting each other. A pair of fixing plates 321 inserting into the first notch 141 projects upwardly and horizontally from two sides of the bottom plate 32. A projecting tab 330 extends backwardly from each side plate 33. The top plate 31 of the shell 30 has a pair of second notches 310 for engaging with the protrusions 15 of the insulative housing 10.

Figure 4:
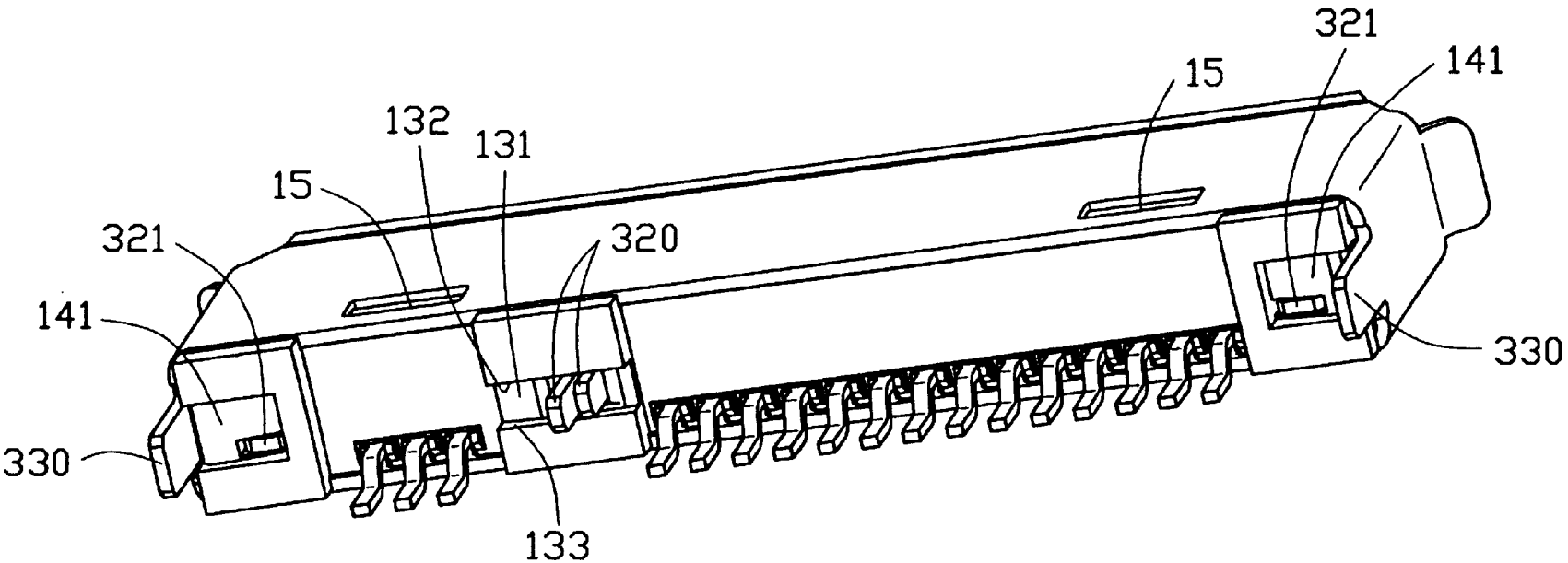
FIG. 4 is an assembled view of the I/O connector of FIG. 3, wherein a pair of cantilevers and projecting tabs are not bent.

Referring to FIG. 4, in assembly, the insulative housing 1 is inserted into the shell 3 from the rear end thereof, and the cantilevers 320 is inserted into the hole 130. The fixing plates 321 are respectively inserted into the grooves 140 for firmly assembling the insulative housing 10 with the shell 30. The protrusions 15 respectively protrude into the corresponding second notch 310 and lock with it for preventing the insulative housing from moving horizontally relative to the shell 30.

Figure 5:
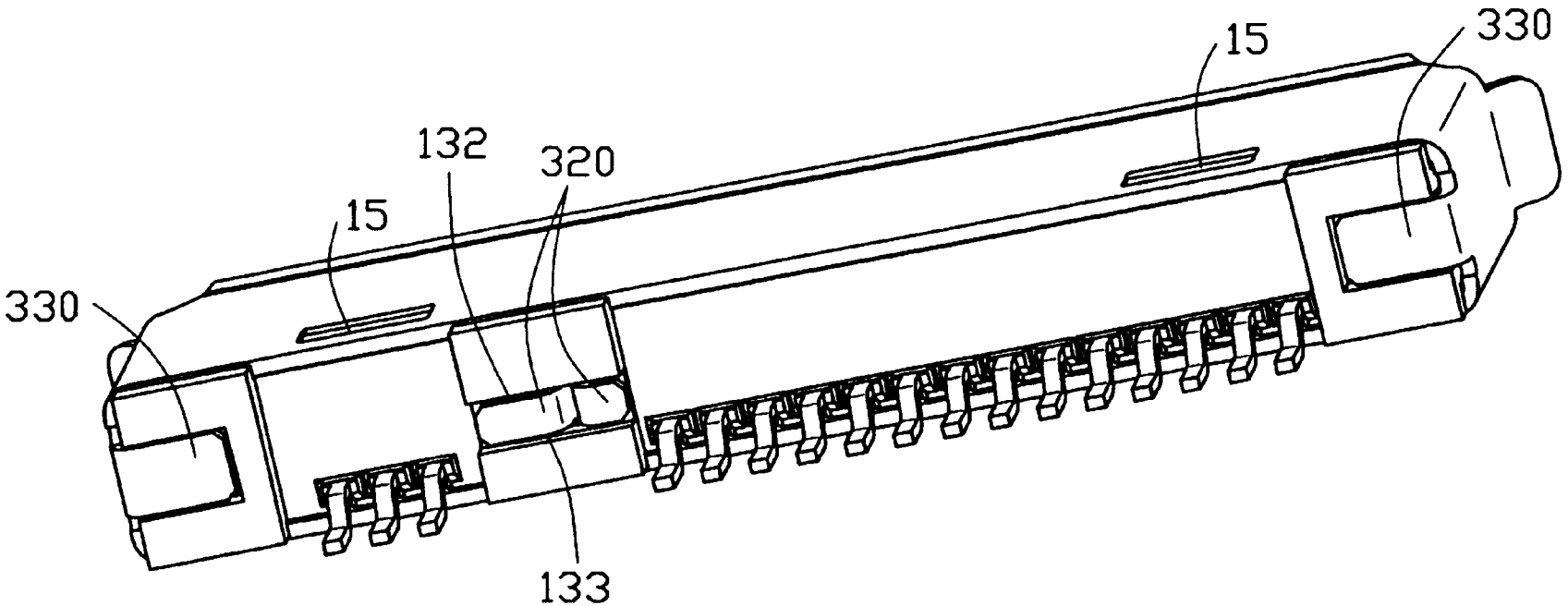
FIG. 5 is an assembled view of the I/O connector of FIG. 3, wherein the pair of cantilevers and the projecting tabs are bent.

Particularly, referring to FIG. 5, each projecting tab 330 is bent to be received in the first notch 141 for assembling the insulative housing 10 and the shell 30. The pair of cantilevers 320 are bent to be received in the recess 131, thereby confines the pair of cantilevers between the upper and the lower surfaces 132, 133 of the recess 131 for further preventing the insulative housing 10 from moving vertically relative to the shell 30.

In the present invention, the cantilevers 320 of the shell 30 are bent to be firmly received in the recess 131 of the insulative housing 10, which make the interference force of the shell 30 and the insulative housing 10 be large, during soldering the I/O connector to the PCB and subsequent cooling process, the shell will not bulges downwardly and the insulative housing 10 will not displace relative to the shell 30, and the conductive contacts 20 can reliably connect with the PCB. Therefore, the present invention overcomes the deficiencies of the conventional I/O connectors.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An input/output connector for mounting on a printed circuit board, comprising:

an insulative housing having a hole extending in a front-to-back direction and a recess communicating with the hole, the recess having an upper wall surface and a lower wall surface;

a plurality of conductive contacts retained in the insulative housing for surface mounting to the printed circuit board; and a shell including a top plate, a bottom plate and a pair of side plates connecting the bottom plate and the top plate, the bottom plate having a pair of cantilevers extending upwardly and rearwardly to insert into the hole of the insulative housing and then be deflected away from each other to be received in the recess of the insulative housing, thereby confining the pair of cantilevers between the upper and the lower surfaces.

2. The connector in accordance with claim 1, wherein the shell is made of a one-piece metal sheet and the cantilevers extend from a respective free end of the metal sheet.

3. The connector in accordance with claim 2, wherein the cantilevers are face-to-face confronting each other.

4. The connector in accordance with claim 3, wherein the insulative housing comprises a first housing portion, a second housing portion and a connecting portion connecting the first housing portion and the second housing portion, and the hole and the recess are defined in the connecting portion.

5. The connector in accordance with claim 1, wherein a pair of securing portions respectively protrude from two sides of the insulative housing.

6. The connector in accordance with claim 5, wherein each securing portion has a groove running through therein and the bottom plate of the shell defines a pair of fixing plates engaging with the groove.

7. The connector in accordance with claim 6, wherein each securing portion has a first notch, and the shell defines a projecting tab corresponding to the first notch.

8. The connector in accordance with claim 7, wherein a top surface of the insulative housing has a pair of protrusions, and the top plate of the shell has a pair of second notches engaging with the protrusions.

9. An electrical connector comprising:

an insulative housing defining a long port and a short port;

a plurality of contacts retained in the long port and the short port;

a unitary metallic shell enclosing said housing, said shell defining opposite top and bottom plates connected by two opposite side plates, a pair of cantilevers each extending in a vertical plane, said pair of cantilevers face to face abutting against and joined with each other for continuity of said bottom plate along a lengthwise direction of said housing; wherein said housing defines a hole extending therethrough in a front-to-back direction perpendicular to said lengthwise direction, and both said pair of cantilevers extend through said hole with end portions thereof deflected away from each other along said lengthwise direction to retain the shell to the housing.

10. The connector in accordance with claim 9, wherein said pair of cantilevers is located between said two ports.

11. The connector in accordance with claim 9, wherein both said pair of cantilevers are interferentially engaged within the hole for enhancement of retention thereof.

12. An electrical connector comprising:

an insulative housing defining an I/O port therein;

a plurality of contacts retained in the housing and communicating with said I/O port;

a unitary metallic shell enclosing said housing, said shell defining opposite top and bottom plates connected by two opposite side plates, a projecting tab extending from a rear edge of one of said side plates;

a fixing plate split from said bottom plate and extending in a front-to-back direction of the housing, said fixing plate being located close to said projecting tab along a lengthwise direction of said housing perpendicular to said front-to-back direction;

a securing portion formed on a lengthwise end of said housing, a notch formed in a back face of said securing portion and extending to an exterior sidewardly, a groove extending through said securing portion along said front-to-back direction; wherein the fixing plate is received in the groove while a tip of said fixing plate is hidden behind said projecting tab which is deflected, along said lengthwise direction, to be received in the notch.

13. The connector in accordance with claim 12, wherein said fixing plate defines in a plane parallel to said top plate and said bottom plate.

* * * * *